US011358764B2

(12) United States Patent
Sterling et al.

(10) Patent No.: US 11,358,764 B2
(45) Date of Patent: Jun. 14, 2022

(54) CHILD-RESISTANT CONTAINER HAVING CAP RETAINER FEATURES

(71) Applicant: Henkel AG & Co. KGaA, Duesseldorf (DE)

(72) Inventors: Daniel Peter Sterling, Fairfield, CT (US); Keith J. Colacioppo, Harrison, NY (US); Michael David Daoust, Sandy Hook, CT (US)

(73) Assignee: Henkel AG & Co. KGaA, Duesseldorf (DE)

( * ) Notice: Subject to any disclaimer, the term of this patent is extended or adjusted under 35 U.S.C. 154(b) by 31 days.

(21) Appl. No.: 15/929,887

(22) Filed: May 28, 2020

(65) Prior Publication Data

US 2021/0371173 A1 Dec. 2, 2021

(51) Int. Cl.
*B65D 50/04* (2006.01)
*B65D 41/04* (2006.01)

(52) U.S. Cl.
CPC ..... *B65D 50/046* (2013.01); *B65D 41/04* (2013.01)

(58) Field of Classification Search
CPC ..... B65D 50/046; B65D 50/041; B65D 41/04
USPC ..... 215/301, 216
See application file for complete search history.

(56) References Cited

U.S. PATENT DOCUMENTS 3,770,153 A * 11/1973 Gach ..... B65D 50/046 215/216
4,116,351 A * 9/1978 Uhlig ..... B65D 50/046 215/216
4,456,136 A * 6/1984 Palsson ..... B65D 41/3409 215/216
4,473,162 A * 9/1984 Donoghue ..... B65D 50/046 215/209
4,630,743 A * 12/1986 Wright ..... B65D 50/046 215/216
4,752,013 A * 6/1988 Miller ..... B65D 41/3409 215/216

(Continued)

FOREIGN PATENT DOCUMENTS

GB 2105693 A 3/1983
WO 20170200922 A1 11/2017

OTHER PUBLICATIONS

Sterling, D.P., U.S. Appl. No. 16/230,258 entitled, "Container and Cap Having Tamper-Evident Member," filed Dec. 21, 2018.

(Continued)

*Primary Examiner* — Ernesto A Grano
(74) *Attorney, Agent, or Firm* — Bojuan Deng

(57) ABSTRACT

A child-resistant container includes a cap with an outer member moveable relative to the axis radially between a first position and a radially displaced position. The container also includes a container body with a neck that engages with an inner member of the cap. The container body has a projection that engages the outer member and limits rotational movement of the cap when the outer member is in the first position and the cap is contemporaneously twisted-off. The outer member bypasses the projection when the outer member is in the radially displaced position and the cap is contemporaneously twisted-off. The projection includes a receiving aperture that receives at least part of the outer member when the outer member is in the first position and the cap is contemporaneously twisted off.

18 Claims, 13 Drawing Sheets

(56) References Cited

U.S. PATENT DOCUMENTS 5,381,911 A * 1/1995 Teicher ..... B65D 50/046 215/202
5,706,963 A * 1/1998 Gargione ..... B65D 50/046 215/217
5,836,466 A * 11/1998 Briere ..... B65D 50/046 215/216
5,915,576 A * 6/1999 Robinson ..... B65D 50/046 215/216
5,921,417 A * 7/1999 Mull ..... B65D 50/046 215/216
5,938,054 A * 8/1999 Loader ..... B65D 50/061 215/206
6,036,036 A * 3/2000 Bilani ..... B65D 50/046 215/216
6,112,921 A * 9/2000 Robinson ..... B65D 50/046 215/216
6,854,613 B2 * 2/2005 Biesecker ..... B65D 50/046 215/218
D589,794 S 4/2009 Branson et al.
D607,326 S * 1/2010 Branson ..... D9/453
7,641,064 B2 * 1/2010 Robinson ..... B65D 50/046 215/216
7,673,763 B1 3/2010 Oh
7,798,348 B2 * 9/2010 Sawyer ..... B65D 47/0809 215/237
7,819,264 B2 * 10/2010 Brozell ..... B65D 50/043 215/222
7,819,265 B2 * 10/2010 Brozell ..... B65D 41/065 215/222
7,874,440 B2 * 1/2011 Gnepper ..... B65D 43/0227 215/222
7,975,862 B2 * 7/2011 Gnepper ..... B65D 83/0481 215/224
7,988,003 B1 8/2011 Clodfelter
8,011,525 B2 * 9/2011 Robinson ..... B65D 50/046 220/281
8,056,742 B2 11/2011 Brozell et al.
8,079,483 B2 * 12/2011 Brozell ..... B65D 41/0471 215/216
8,091,709 B2 1/2012 Gnepper
8,123,058 B2 * 2/2012 Brozell ..... B65D 41/0471 215/216
8,210,376 B2 * 7/2012 Robinson ..... B65D 50/046 215/330
8,235,616 B2 * 8/2012 Raccah ..... B65D 50/041 401/129
8,240,491 B2 * 8/2012 Beecroft ..... B65D 50/048 215/216
8,251,236 B1 8/2012 Robinson et al.
8,650,839 B1 2/2014 Robinson et al.
8,651,312 B2 2/2014 Minnette
9,422,091 B2 * 8/2016 Martin ..... B65D 50/046
9,771,190 B2 * 9/2017 Piscopo ..... B65D 50/046
9,850,040 B2 * 12/2017 Scott ..... B65D 41/0485
9,889,977 B2 * 2/2018 Piscopo ..... B65D 50/046
10,676,257 B2 * 6/2020 Girardot ..... D06F 39/024
10,822,148 B2 * 11/2020 Sterling ..... B65D 55/024
10,850,898 B2 * 12/2020 Sterling ..... B65D 41/0471
2005/0121406 A1 * 6/2005 Brozell ..... B65D 41/0471 215/216
2006/0108312 A1 * 5/2006 Robinson ..... B65D 50/046 215/216
2007/0284331 A1 * 12/2007 Miota ..... B65D 47/0804 215/320
2016/0167838 A1 * 6/2016 Dong ..... B65D 50/041 220/255
2018/0228269 A1 * 8/2018 Tapocik ..... B65D 50/041
2020/0198855 A1 * 6/2020 Sterling ..... B65D 50/043
2020/0198856 A1 * 6/2020 Sterling ..... B65D 50/043

OTHER PUBLICATIONS

European Search Report Application No. EP 21 17 2361 Completed Oct. 6, 2021 dated Oct. 18, 2021 10 Pages.

* cited by examiner

CHILD-RESISTANT CONTAINER HAVING CAP RETAINER FEATURES

FIELD OF THE INVENTION

The following relates to a container and relates, more particularly, to a child-resistant container having cap retainer features.

BACKGROUND OF THE INVENTION

A child-resistant container is designed to reduce the ease with which children are able to access the contents stored within the container. A container body having a neck may be rendered child-resistant through the usage of a specialized cap. Certain actions may be needed to detach the cap from the container body, and those actions may be typically difficult for a child to perform.

While often relatively non-complex in a structural sense, child-resistant cap assemblies can be deceptively difficult to design. An inexorable tradeoff is encountered in designing a child-resistant cap assembly that the vast majority of adults find intuitive and relatively non-cumbersome to use, while most children find prohibitively difficult to open. Relatively few, if any conventional child-resistant cap assemblies strike an ideal balance between these competing factors. There thus exists an ongoing demand for child-resistant containers providing enhanced child deterrence characteristics, while further maintaining or improving adult ease-of-use. Concurrently, it would be desirable for such child-resistant cap assemblies to be amenable to cost effective manufacture.

BRIEF SUMMARY OF THE INVENTION

Embodiments of a child-resistant container are provided. In various embodiments, the child-resistant container includes a cap with a cover member, an inner member that depends from the cover member, and an outer member that depends from the cover member. An axis extends through the cover member. The outer member is moveable relative to the axis radially between a first position and a radially displaced position. The outer member of the cap includes a squeeze actuator with a first pad and a second pad that are disposed on opposite sides of the axis and aligned along a squeeze axis that is spaced away radially from the axis. The first and second pads are configured for manual squeezing along the squeeze axis for selective movement of the outer member from the first position toward the radially displaced position. The container also includes a container body with a neck that defines an opening to an inner cavity within the container body. The axis extends through the opening. The neck engages with the inner member to support rotational movement of the cap in a twist-off direction and a twist-on direction about the axis. The container body has a projection that engages the outer member and limits rotational movement of the cap when the outer member is in the first position and the cap is contemporaneously rotated in the twist-off direction. The outer member bypasses the projection when the outer member is in the radially displaced position and the cap is contemporaneously rotated in the twist-off direction. The projection includes a receiving aperture that receives at least part of the outer member when the outer member is in the first position and the cap is contemporaneously rotated in the twist-off direction.

Methods for manufacturing a child-resistant container are also provided. In some embodiments, the method includes providing a cap with a cover member, an inner member that depends from the cover member, and an outer member that depends from the cover member. An axis extends through the cover member. The outer member is moveable relative to the axis radially between a first position and a radially displaced position. The outer member of the cap includes a squeeze actuator with a first pad and a second pad that are disposed on opposite sides of the axis and aligned along a squeeze axis that is spaced away radially from the axis. The first and second pads are configured for manual squeezing along the squeeze axis for selective movement of the outer member from the first position toward the radially displaced position. The method also includes providing a container body with a neck that defines an opening to an inner cavity within the container body. The axis extends through the opening. The container body includes a projection with a receiving aperture. Furthermore, the method includes engaging the neck of the container body with the inner member of the cap to support rotational movement of the cap in a twist-off direction and a twist-on direction about the axis. The projection is engageable with the outer member to limit rotational movement of the cap when the outer member is in the first position and the cap is contemporaneously rotated in the twist-off direction. The outer member bypasses the projection when the outer member is in the radially displaced position and the cap is contemporaneously rotated in the twist-off direction. The receiving aperture receives at least part of the outer member when the outer member is in the first position and the cap is contemporaneously rotated in the twist-off direction.

The foregoing statements are provided by way of non-limiting example only. Various additional examples, aspects, and other features of embodiments of the present disclosure are encompassed by the present disclosure and described in more detail below.

BRIEF DESCRIPTION OF THE DRAWINGS

At least one example of the present disclosure will hereinafter be described in conjunction with the following figures, wherein like numerals denote like elements, and.

Figure 1A:
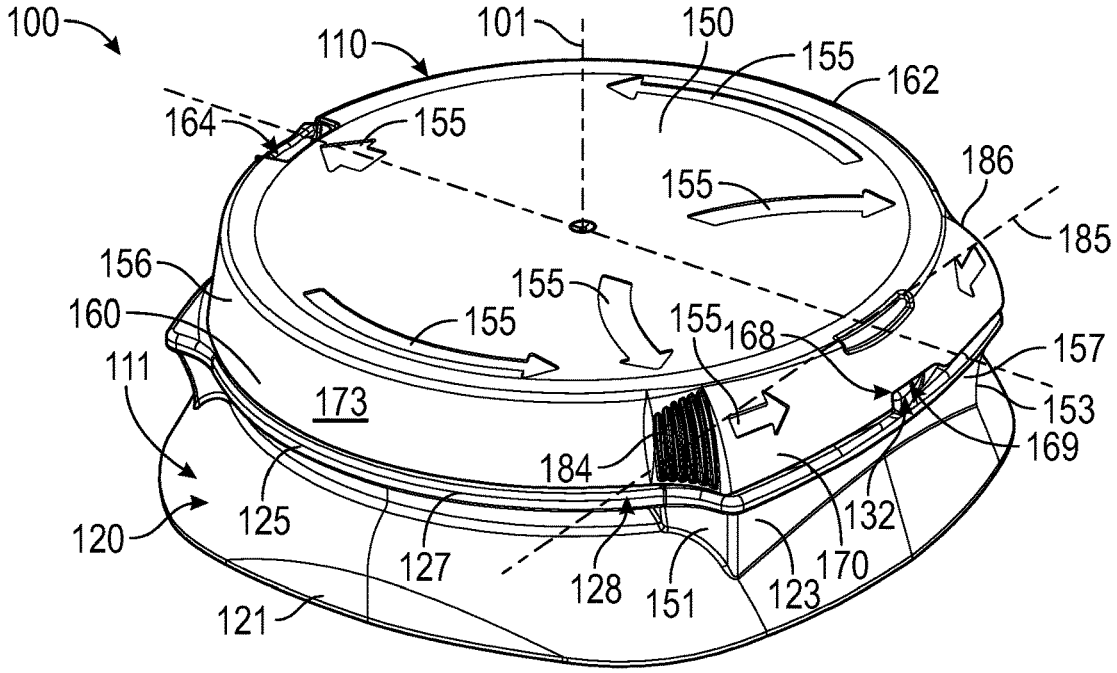
FIG. 1A is an isometric view of a child-resistant container with a cap shown attached to a container body according to example embodiments of the present disclosure.

For simplicity and clarity of illustration, descriptions and details of well-known features and techniques may be omitted to avoid unnecessarily obscuring the exemplary and non-limiting embodiments of the present disclosure described in the subsequent Detailed Description. It should further be understood that features or elements appearing in the accompanying figures are not necessarily drawn to scale unless otherwise stated.

DETAILED DESCRIPTION OF THE INVENTION

The following Detailed Description is merely exemplary in nature and is not intended to limit the present disclosure or the application and uses of the same. The term "exemplary," as appearing throughout this document, is synonymous with the term "example" and is utilized repeatedly below to emphasize that the following description provides only multiple non-limiting examples of the present disclosure and should not be construed to restrict the scope of the present disclosure, as set-out in the Claims, in any respect.

Child-resistant containers (i.e., child-deterring containers) including child-resistant caps and corresponding container bodies are provided, as are methods for manufacturing such articles. Generally, the child-resistant containers described herein and their components restrict access to the container contents providing effective child deterrence, while further ensuring adult ease-of-use. This is accomplished through the provision of a container body and a cap with corresponding child-deterring features. The cap may be removably attached to a neck of the container body for closure of an opening into the container body. For example, the cap may be threadably attached to the neck of the container body. As such, rotation of the cap in a first direction (i.e., the twist-off direction, opening direction, unscrewing direction, unthreading direction, etc.) moves the cap off the container body to open the container. Rotation in a second, opposite direction (the twist-on direction, closing direction, screwing direction, threading direction, etc.) moves the cap onto the container body. The container and cap may cooperate to define at least one cap retainer feature that retains the cap on the container body, thereby restricting access to the contents of the container.

In some embodiments, the retainer feature may include a projection of the container body that projects radially outward with respect to an axis of the container body opening. Also, the cap may include a corresponding lug that is engageable with the projection to limit rotation of the cap in the twist-off direction. The lug may be supported on a portion of the cap that is selectively moveable between a first position and a second position. In the first position, the lug may engage the projection to limit rotation of the cap in the twist-off direction. In the second position, the lug may bypass the projection to allow twist-off and removal of the cap from the container body.

The projection of the container body may also include a receiving aperture. The receiving aperture may accommodate and receive the lug to further secure the cap on the container body. Specifically, if the lug is in the first position and the cap is moved in the twist-off direction, the lug may move and wedge into the aperture of the projection, thereby robustly securing the cap to the container body.

Thus, one or more aspects of the container of the present disclosure can render the cap relatively challenging for a vast majority of children to defeat or bypass, while maintaining a desired level of ease-of-use for adults. Additionally, these features may be highly manufacturable. Exemplary embodiments of a child-resistant container will now be described in reference to the Figures.

FIGS. 1A-3 illustrate a child-resistant container 100 that generally includes a cap 110 and a container body 120 in accordance with exemplary and non-limiting embodiments of the present disclosure. It will be appreciated that the term "child-resistant" as used herein is used broadly to mean a container that includes one or more features that selectively deters a user, such as a young child, from removing the cap 110 from the body 120 and gaining access to an inner cavity within the container 100. In some embodiments, the child-resistant container 100 may satisfy certain established standards, such as ASTM D3475-15, entitled "Standard Classification of Child Resistant Packages;" however, the child-resistant container 100 may fall outside of such standards without departing from the scope of the present disclosure.

The container body 120 may be a vessel or bottle that is configured for holding a variety of materials. Also, in some embodiments, the container body 120 may be a plastic and unitary article. The shape and dimensions of the container body 120 may vary among different embodiments.

The container body 120 may include a hollow tub portion 121 that defines an inner cavity 119 therein. The tub portion 121 may be cuboid, rounded, or otherwise shaped. The container body 120 may also include a neck 126 and shoulder 111. The shoulder 111 and neck 126 may be centered about an axis 101 with the shoulder 111 disposed between the tub portion 121 and the neck 126. The neck 126 may be annular and may define a throat or opening that provides physical access to the inner cavity within the tub portion 121 when the cap 110 is removed from the container body 120. The shoulder 111 may gradually reduce in width (diameter) as it extends from the tub portion 121 to the neck 126. The opening of the neck 126 may be substantially circular in some embodiments. In some embodiments, at least some elements of the neck 126 and/or shoulder 111 may be disposed with rotational symmetry in at least two distinct rotational positions with respect to the axis 101.

The tub portion 121, shoulder 111, and neck 126 may be integrally formed (via blow-molding, injection molding, additive manufacturing, etc.) as a single, unitary container body 120 in some embodiments. In further embodiments, at least one of these features can be separately fabricated from the same, similar, or dissimilar materials as the others and subsequently joined in some manner. For example, in one implementation, the container neck 126 and shoulder 111 can be fabricated as a blow molded, injection molded, or additively manufactured piece, while the rest of the container body 120 is separately produced as a non-rigid structure (e.g., a flexible bag or collapsible vessel) to which the neck 126 and shoulder 111 is subsequently attached. Various other constructions are also possible. While such a structural design will generally be less common than that shown in FIGS. 1A and 1B, this is nonetheless noted to further emphasize that the container 100 is highly adaptable and can be incorporated into a wide range of packaging types.

The container body 120 may also include a collar 128 that defines a transition between the shoulder 111 and neck 126. The collar 128 may project outward radially from the axis 101. In some embodiments, the collar 128 may exhibit rotational symmetry with respect to the axis 101. As illustrated, the collar 128 may be rotationally symmetric in two rotational positions that are 180° apart. The collar 128 may include a perimeter 127 that extends continuously about the neck 126. The perimeter 127 may lie substantially within a plane that is perpendicular to the axis 101. The collar 128 may include at least one arcuate portion 125 and at least one radially projected portion 123. For example, as illustrated, there may be two arcuate portions 125 spaced apart circumferentially and disposed on opposite sides of the axis 101 as well as two projected portions 123 spaced apart circumferentially and disposed on opposite sides of the axis 101. The arcuate portions 125 may have a substantially constant radius. The projected portions 123 may be identical and disposed 180° apart. The projected portions 123 may include a first side wall 151, a second side wall 153, and a front wall 157. The first and second side walls 151, 153 may extend vertically along the axis 101. The front wall 157 may extend along the axis 101, tangential to the axis 101, and between the first and second side walls 151, 153. The projected portions 123 may also include a platform surface 145 (FIG. 1B) that faces axially upward along the axis 101.

The neck 126 may project axially from the platform surface 145. As shown in FIG. 1B, the neck 126 may include a neck thread 130 (i.e., container threading) for threadably engaging the cap 110. The neck thread 130 may include at least one outwardly projected rib that extends along the neck 126 helically about the axis 101. In some embodiments, the neck thread 130 may include a plurality of such ribs, each extending continuously between terminal ends. As such, in some embodiments, the neck thread 130 may comprise two ribs, spaced 180° apart. Also, the neck thread 130 may be a multi-entry thread meaning that the cap 110 can engage the neck thread 130 in a plurality of distinct rotational positions with respect to the axis 101. In some embodiments, the neck thread 130 may be a dual-entry thread, allowing the cap 110 to thread onto the neck 126 in a first rotational position and, alternatively, in a second rotational position spaced apart by 180°. However, it will be appreciated that the neck thread 130 may be a single-entry thread allowing the cap 110 to thread onto the neck 126 from a solitary rotational position relative thereto. The neck thread 130 and the corresponding threading on the cap 110 may be configured to firmly secure the cap 110 onto the neck 126.

Moreover, the neck 126 may include at least one thread stop 131. The thread stop 131 may be a rectangular projection disposed proximate the lower end of the neck thread 130. In some embodiments, there may be a plurality of thread stops 131 (e.g., two thread stops 131), each disposed proximate lower terminal ends of the ribs of the neck thread 130. The thread stop(s) 131 may extend parallel to the axis 101 between the platform surface 145 and the lower terminal end of the respective rib of the neck thread 130. The thread stops 131 may be positioned to stop rotation of the cap 110 after rotating approximately 180° onto the neck 126.

Furthermore, as shown in FIGS. 1-4, the container body 120 may include a first projection 132 (i.e., a first container lug). The projection 132 may be a lug, ridge, bump, or other projection that projects radially away from the axis 101. The projection 132 may be disposed proximate the neck 126, shoulder 111, and/or collar 128. The projection 132 may project outward, radially away therefrom. In some embodiments, the projection 132 may project upward and axially from the platform surface 145 and may also project radially away from the neck 126. The projection 132 may be wedge-shaped in some embodiments. The projection 132 may include an abutment surface 134 that faces in a tangential direction and/or in a circumferential direction with respect to the axis 101 (in a direction that opposes the twist-off direction of the cap 110). The projection 132 may further include a tapered surface 136. The tapered surface 136 may face outward radially with respect to the axis 101. The tapered surface 136 may extend away from the abutment surface 134, and the radius of the tapered surface 136 may gradually reduce as the tapered surface 136 transitions toward the neighboring area of the neck 12. The tapered surface 136 may be eccentric relative to the axis 101. The projection 132 may additionally include a top surface 137 that is disposed substantially normal to the axis 101.

Figure 4:
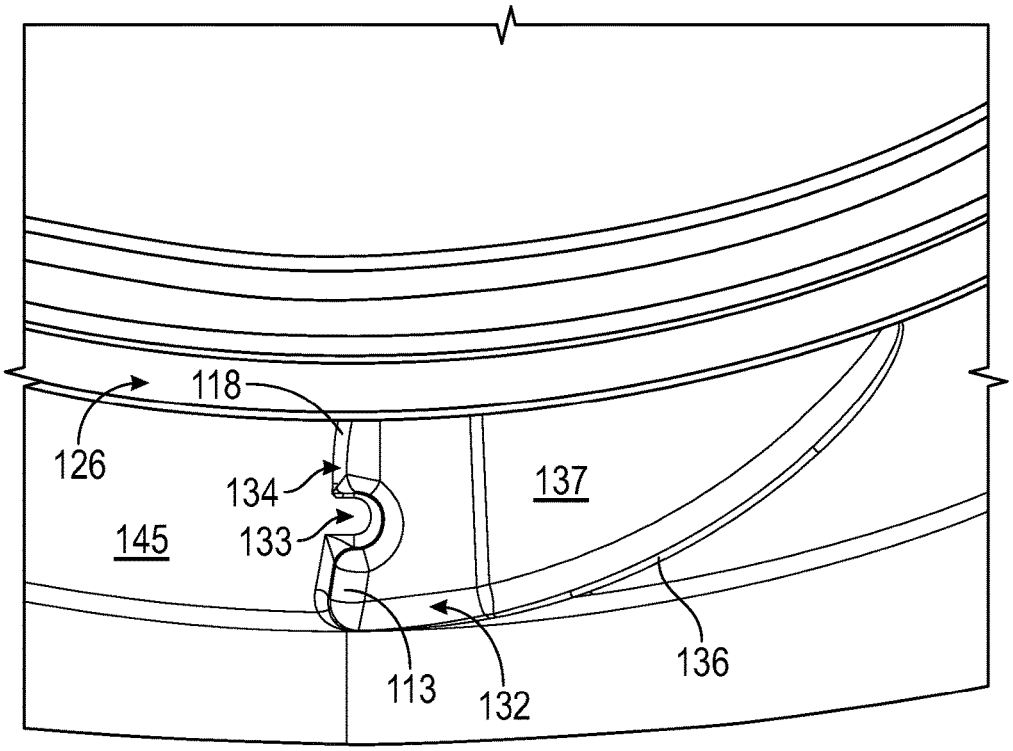
FIG. 4 is a top view of the container body of the container of FIGS. 1A and 1B.

The container body 120 may further include an aperture 133 (a receiving aperture). The aperture 133 may be included on the projection 132 in some embodiments. The aperture 133 may be a recess, groove, notch, or other void defined in the abutment surface 134 and/or the top surface 137. As shown in FIG. 4, the aperture 133 may radially separate a neck side 118 of the abutment surface 134 and an outer lip 113 of the projection 132. In other words, the aperture 133 is disposed radially inward from the lip 113 of the first projection. The aperture 133 may have a variety of shapes without departing from the scope of the present disclosure. For example, the aperture 133 may be scoop-shaped and may include surfaces that face upward in the axial direction, inward in the radial direction, outward in the radial direction, and circumferentially in a direction that opposes the twist-off direction.

Figure 3:
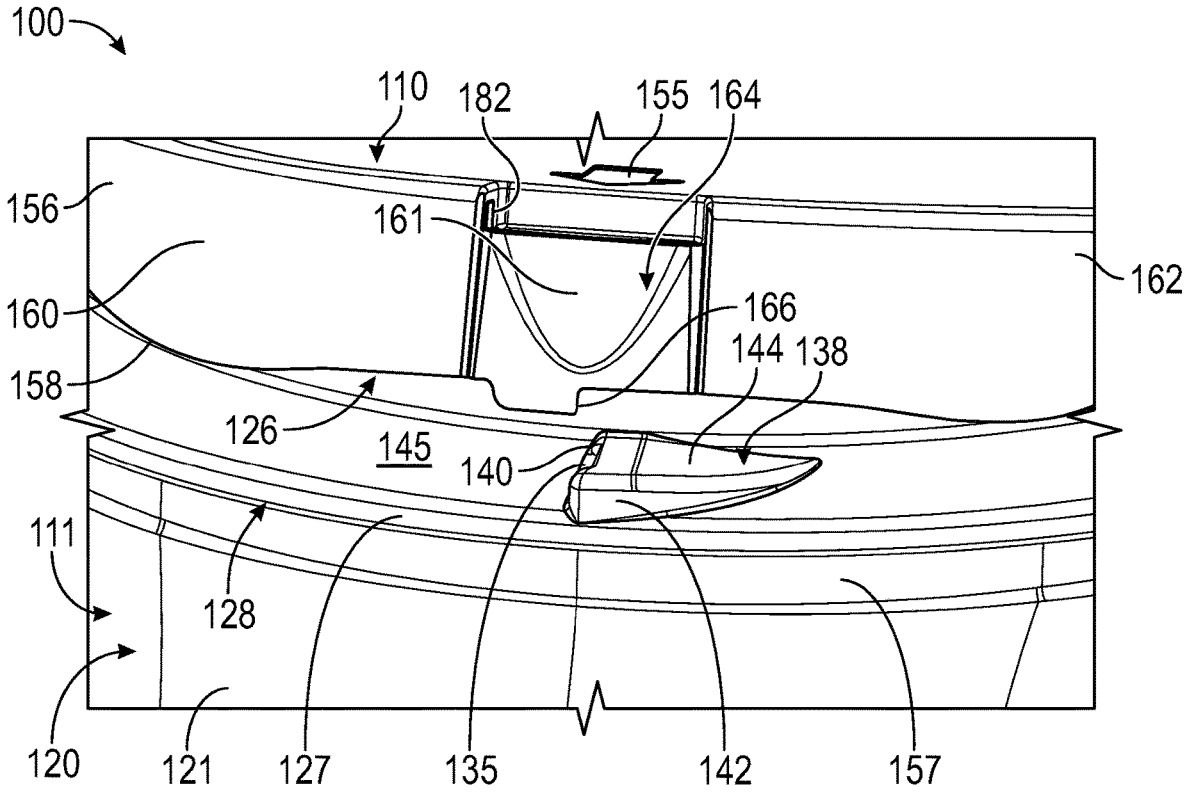
FIG. 3 is an exploded isometric view of a second retainer feature of the container of FIGS. 1A and 1B.

As shown in FIG. 3, the container body 120 may further include a second projection 138 (i.e., a second lug). The second projection 138 may be substantially similar to the first projection 132. For example, the second projection 138 may include a respective abutment surface 140, tapered surface 142, and top surface 144. The second projection 132 may further include an aperture 135, which corresponds in shape and position to the aperture 133 of the first projection 132. The abutment surface 140 may be oriented to face in the same circumferential/tangential direction as the abutment surface 134 of the first projection 132 (in the direction opposing twist-off of the cap 110). The second projection 138 and the first projection 132 may be disposed approximately at the same axial position with respect to the axis 101.

The second projection 138 may be spaced apart circumferentially from the first projection 132. For example, in some embodiments, the first and second projections 132, 138 may be disposed on opposite sides of the axis 101. The first projection 132 may be disposed on the front side of the container body 120 at a zero-degree position with respect to the axis 101, and the second projection 138 may be disposed on the rear side of the container body 120 at a one-hundred-eighty-degree position with respect to the axis 101. In other words, the first and second projections 132, 138 may be spaced apart approximately one-hundred-eighty degrees (180°) with respect to the axis 101, and the projections 132, 138 may exhibit rotational symmetry in two rotational positions spaced 180° apart.

Figure 1B:
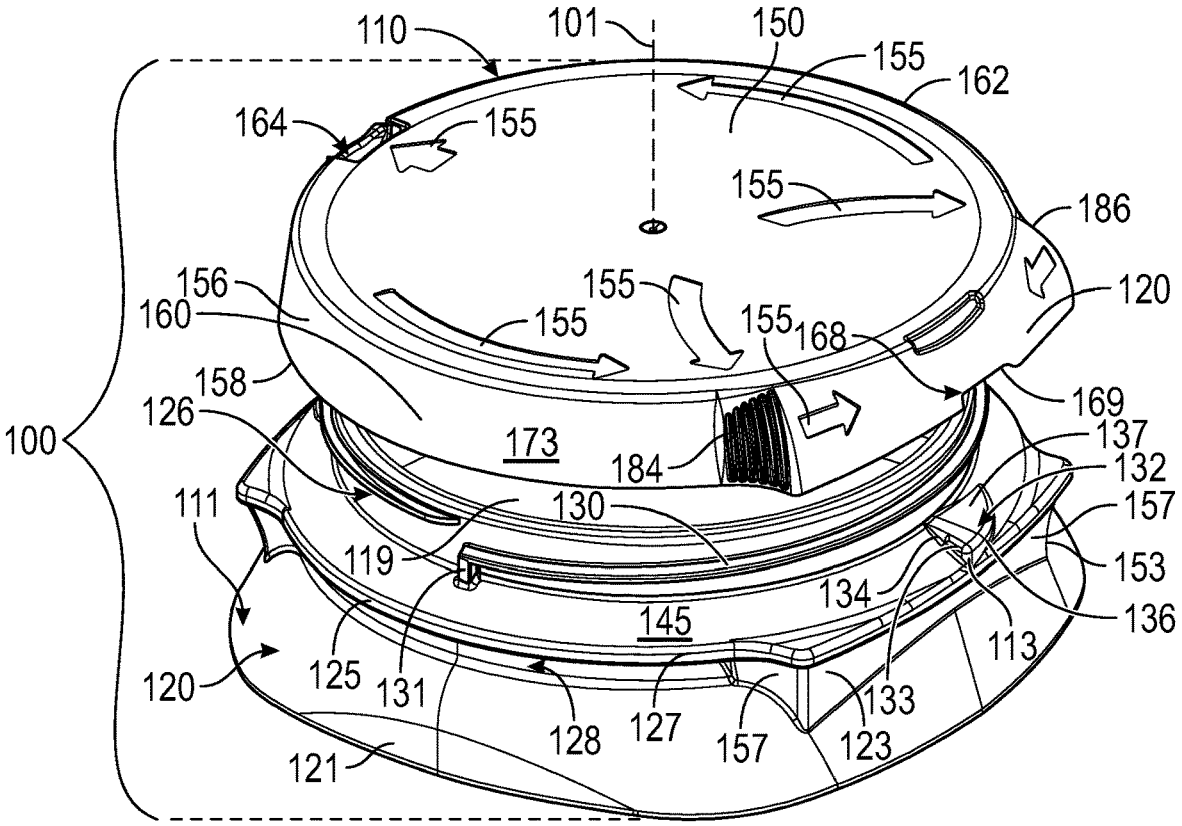
FIG. 1B is an isometric exploded view of the container of FIG. 1A.
Figure 5:
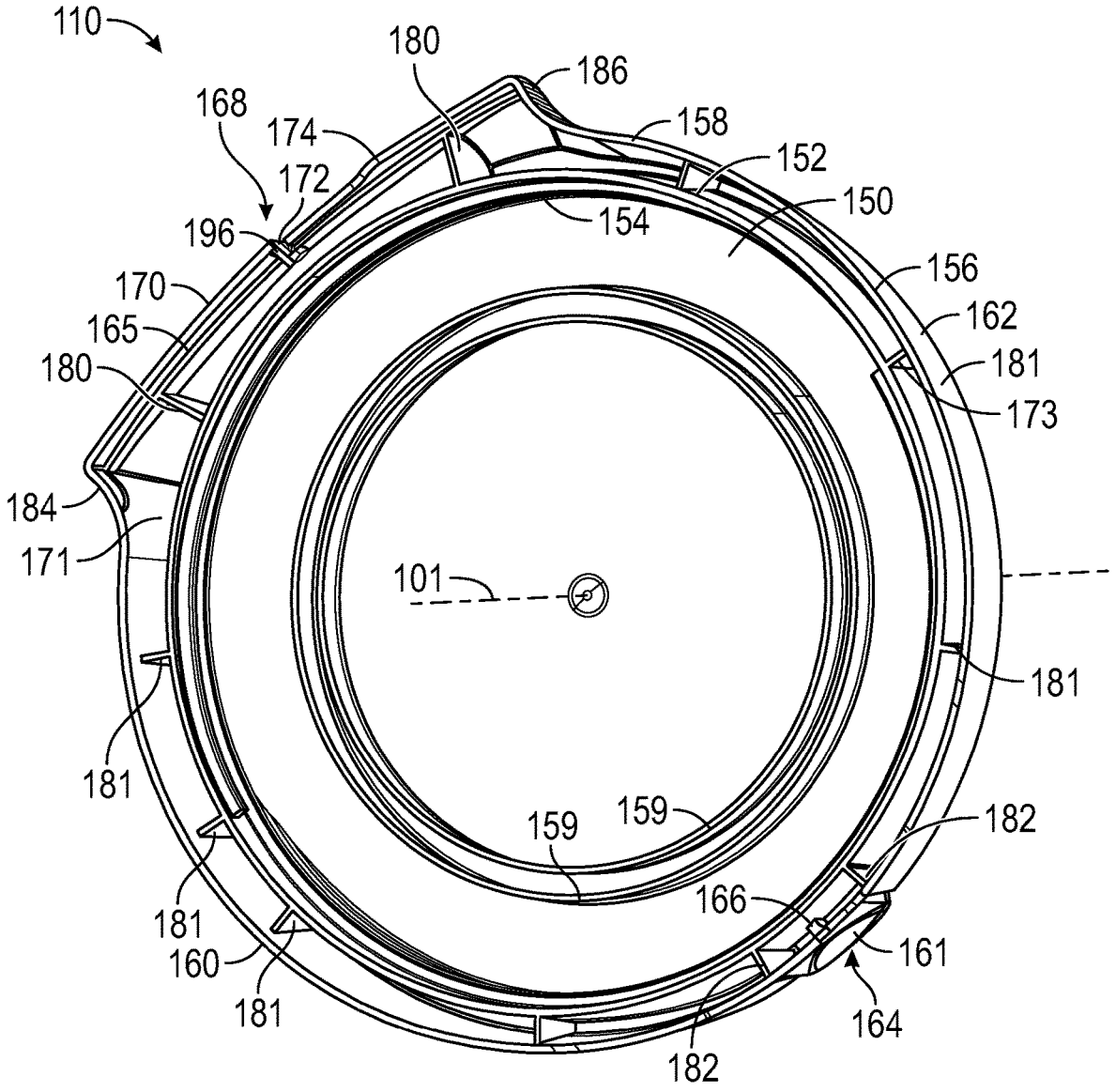
FIG. 5 is a bottom view of the cap of the container of FIGS. 1A and 1B.

Referring now to FIGS. 1A, 1B, and 5, the cap 110 will be discussed in detail according to example embodiments. The cap 110 may be relatively flat and disc-shaped in some embodiments. Also, in some embodiments, the cap 110 may be an injection molded, plastic, and unitary (i.e., monolithic, one-piece) article. In some embodiments, one or more outer surfaces 173 of the cap 110 may include illustrations or other messages, such as instructions to the user for removing the cap 110. One or more of these surfaces may include embossed or debossed arrows 155, illustrations, alphanumeric symbols, or other indicators for how to manipulate the cap 110 for removal from the container body 120.

The cap 110 may include a cover member 150, which may be a substantially circular and flat disc. The cover member 150 may be substantially planar and may be disposed normal to the axis 101. The axis 101 may extend through a central area of the cover member 150. When attached to the container body 120, the cover member 150 may cover over the opening through the neck 126 and restrict access to the inner cavity of the container body.

Also, the cap 110 may include an inner member that depends from the cover member 150 and that is engageable with the neck 126, such as an inner skirt 152 (FIG. 5). The inner skirt 152 may be annular and may extend continuously about the axis 101. The inner skirt 152 may be attached at one end to the underside of the cover member 150 and may depend therefrom. The inner skirt 152 may be substantially centered about and centered on the axis 101. The inner skirt 152 may be configured so as receive the neck 126 and engage the neck 126. In additional embodiments, the inner skirt 152 may be configured to be received within the neck 126 and to engage the neck 126.

As shown in FIG. 5, the cap 110 may include a cap thread 154. The cap thread 154 may be disposed on an inner diameter surface of the inner skirt 152 and may correspond to the neck thread 130 for threadably engaging the container body 120. Thus, as discussed above, the neck thread 130 and cap thread 154 may allow dual entry (i.e., threading on of the cap 110) in one of two rotational positions in some embodiments. As shown, the cap thread 154 may include at least one inwardly projecting rib that extends helically about the axis 101. Although the inner skirt 152 is configured for covering over the neck 126 in the illustrated embodiment, it will be appreciated that the inner skirt 152 may be received within the neck 126 without departing from the scope of the present disclosure. For example, in other embodiments, the cap thread 154 may be included on the outer diameter surface of the inner skirt 152, and the neck thread 130 may be included on the inner diameter surface such that the inner skirt 152 is received within the neck 126 and is removably attached thereto. Furthermore, in additional embodiments of the present disclosure, the cap 110 may be removably attached to the neck 126 in a manner other than a threaded attachment. In these embodiments, the neck 126 may rotationally support the cap 110 for rotational movement in the twist-off direction (to remove the cap 110) and, alternatively, in the twist-on direction (to secure the cap 110 on the container body 120).

The cap 110 may additionally include an outer member, such as an outer skirt 156, that depends from the cover member 150. The outer skirt 156 may be attached to the outer periphery of the cover member 150 and may depend therefrom. In some embodiments, the outer skirt 156 may continuously extend about the axis 101. Also, the outer skirt 156 may be spaced apart outwardly in the radial direction from the inner skirt 152. As such, the outer skirt 156 may extend about the axis 101 and may surround, encompass, and/or encircle the inner skirt 152.

The outer skirt 156 may include an inner surface 171 that faces inward radially toward the inner skirt 152 and toward the axis 101. The outer skirt 156 may also include an outer surface 173 that faces outward radially from the axis 101. Moreover, the outer skirt 156 may include a lower edge 158 that is spaced apart from the cover member 150 along the axis 101. The lower edge 158 of the outer skirt 156 may be disposed lower than the inner skirt 152 with respect to the axis 101.

The outer surface 173 of the outer skirt 156 and the top surface of the cover member 150 may cooperatively define the exterior of the cap 110. The outer surface 173 may define the outer radial exterior surfaces of the cap 110. When the cap 110 is attached to the container body 120, these same surfaces may define the exterior portions of the container 100 that cover over the neck 126 and the opening therethrough.

The outer skirt 156 may be sub-divided into different members, areas, and/or portions. For example, the outer skirt 156 may include a first arcuate segment 160 and a second arcuate segment 162. The first and second arcuate segments 160, 162 may have a common radius, may be disposed on opposite sides of the axis 101, and may be substantially centered on the axis 101.

Figure 7:
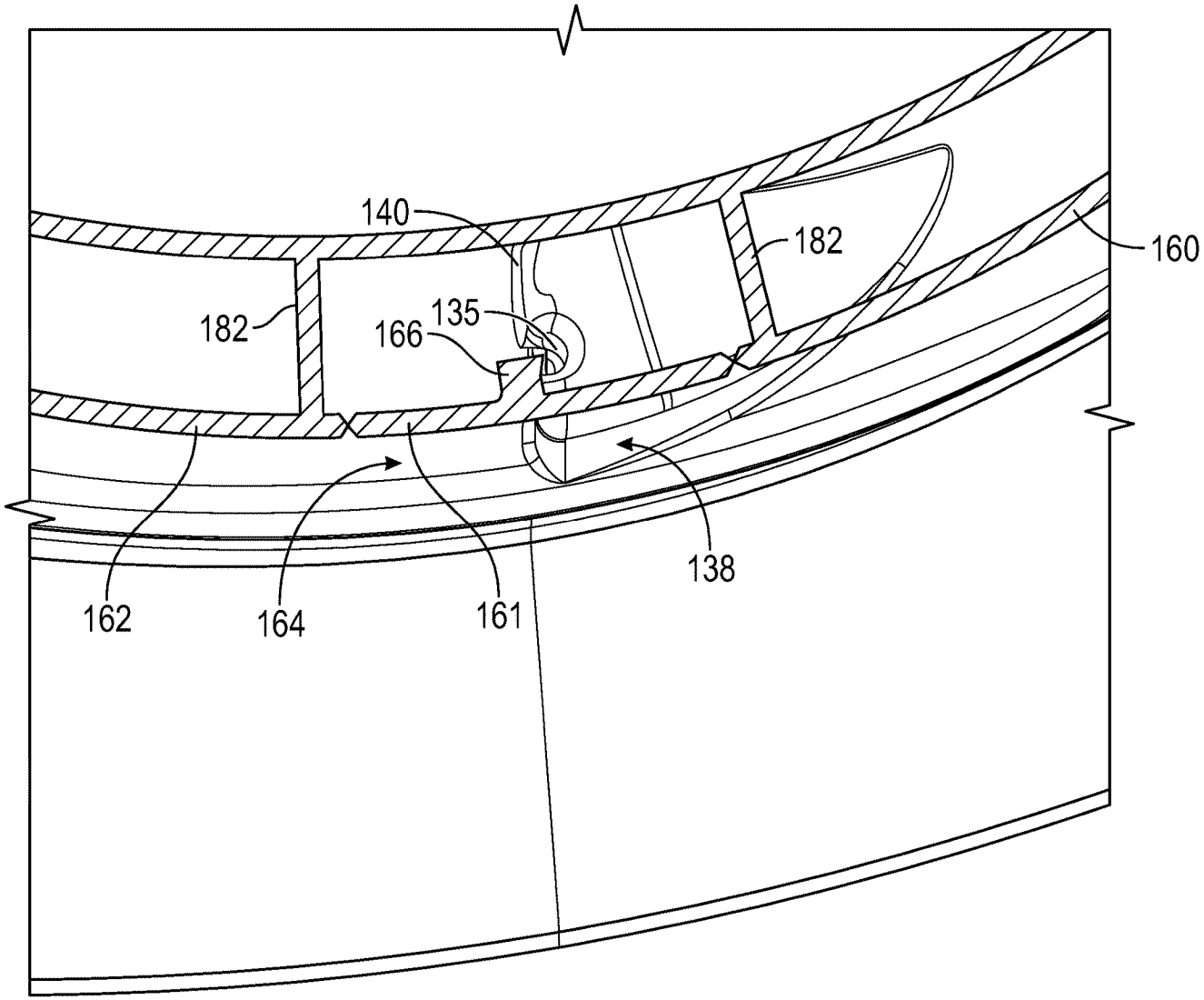
FIG. 7 is a top cross-sectional view of the second retainer feature of FIG. 3.

The cap 110 may further include one or more members that cooperate with the first and/or second projections 132, 138 of the container body 120 to define one or more cap retainer features. For example, the outer skirt 156 may include a tamper-evident member 164 that cooperates with the second projection 138 to define one cap retainer feature. The tamper-evident member 164 may be disposed circumferentially between neighboring ends of the first and second arcuate segments 160, 162 of the outer skirt 156. As shown in FIGS. 3, 5, and 7, the tamper-evident member 164 may include a tab 161 that is removably connected to the ends of the segments 160, 162 (FIG. 3). The bottom edge of the outer skirt 156 may gradually taper on both circumferential sides of the tab 161. Also, the tamper evident member 164 may also include an abutment member 166. The abutment member 166 may project axially from the bottom edge of the tab 161 and/or may project inward radially from the tab 161. The abutment member 166 may be sized, positioned, and/or otherwise configured to be received within the aperture 135 of the second projection 138 when the cap 110 is fully threaded onto the container body 120. As shown in FIG. 7, the abutment member 166 of the tamper-evident member 164 may be disposed adjacent abutment surface 140 of the second projection 138. In some embodiments, at least part of the abutment member 166 may be received in the aperture 135 in this position. As such, the projection 138 may limit rotation of the cap 110 due to interference with the abutment member 166 unless the tab 161 is first removed from the rest of the cap 110. In other words, the abutment member 166 may engage the second projection 138 to thereby retain the cap 110 on the container body 120. Also, the tamper-evident member 164 may be selectively deformable. For example, the tamper-evident member 164 may be a frangible member that may be at least partially removed from the cap 110. For example, in some embodiments, the tab 161 may be manually peeled and torn away axially (e.g., downward toward the container body 120). This action may disconnect the tamper-evident member 164 from the first and second arcuate segments 160, 162 of the outer skirt 156. Once removed, the tamper-evident member 164 no longer retains the cap 110 on the container body 120, thereby allowing removal of the cap 110 as will be discussed.

Figure 2:
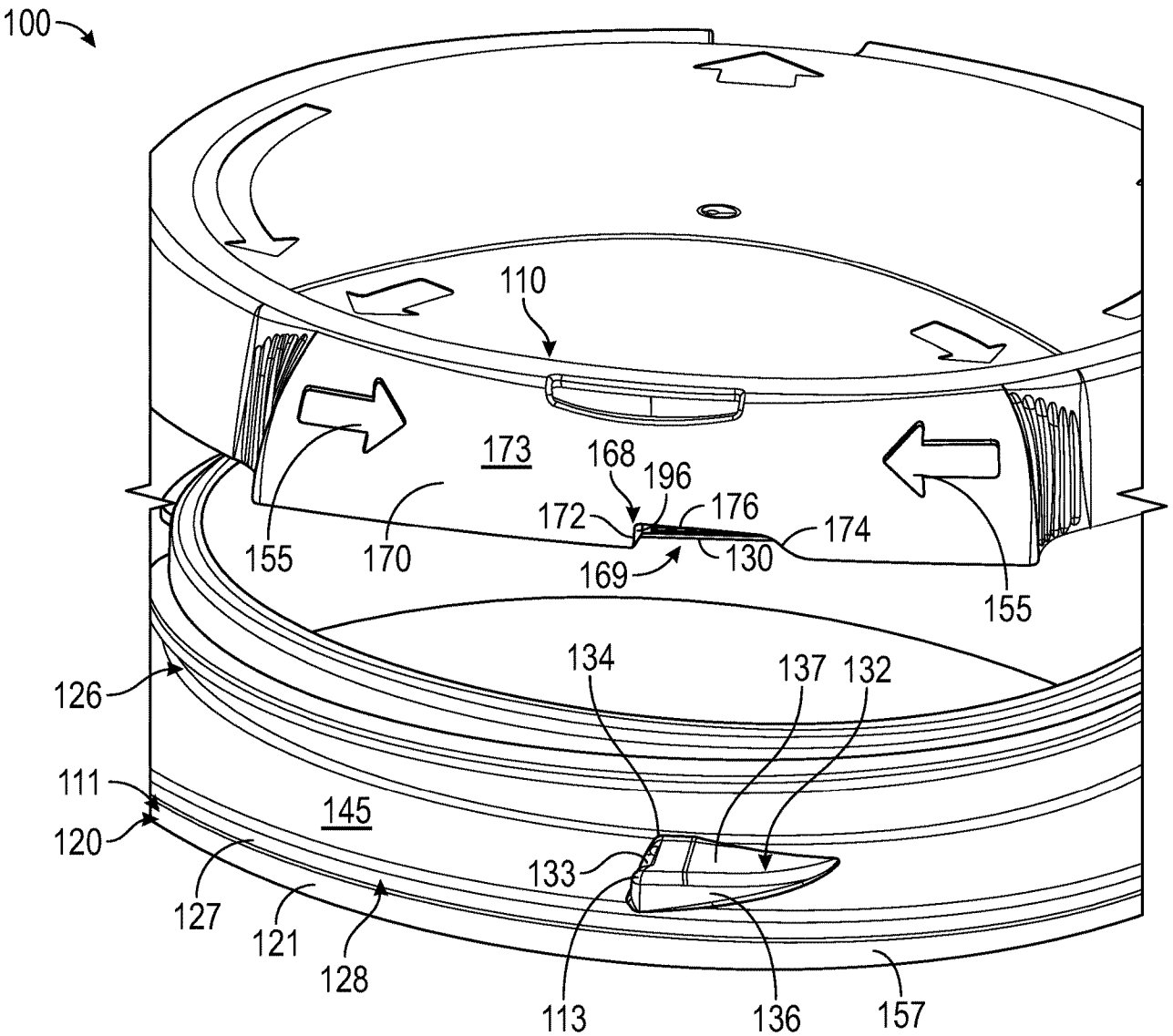
FIG. 2 is an exploded isometric view of a first retainer feature of the container of FIGS. 1A and 1B.

As shown in FIGS. 2 and 5, the outer skirt 156 may include a retainer feature 168 that cooperates with the first projection 132 of the container body 120 to retain the cap 110 on the container body 120. In some embodiments, the retainer feature 168 may be included with the tamper-evident member 164 to define an additional cap retainer feature. In general, the retainer feature 168 may be selectively moveable between various positions. For example, the retainer feature 168 may be resiliently flexible and moveable from a neutral position to a flexed position. The retainer feature 168 may be biased toward the neutral position and away from the flexed position. The retainer feature 168 may be selectively moved between these positions to removably secure the cap 110 to the neck 126.

The retainer feature 168 may comprise a resiliently flexible wall 170 of the outer skirt 156. The wall 170 may be projected outward radially from the first and second arcuate segments 160, 162, and the wall 170 may extend substantially tangentially with respect to the axis 101.

The retainer feature 168 may additionally include a lug 196 (abutment member). The lug 196 may be attached to the wall 170 and may project inward radially therefrom. The lug 196 may extend axially to the lower edge 158 of the outer skirt 156. In some embodiments represented in FIG. 6, the lug 196 may be hook-shaped so as to include a radial portion 197 and a catch 198. The radial portion 197 may project radially inward from the wall 170. The catch 198 may be spaced inwardly radially from the wall 170 and may project in the circumferential/tangential direction in the direction of twist-off of the cap 110.

The outer skirt 156 may further include a first pad 184 and a second pad 186 (FIGS. 1A, 1B). The first pad 184 and the second pad 186 may be disposed on opposite ends of the wall 170. As shown in FIG. 5, the first pad 184 may project radially outward and may contour concavely from the first arcuate segment 160 to the wall 170. The second pad 186 may project radially outward and may contour concavely from the second arcuate segment 162 to the wall 170. Furthermore, the first and/or second pads 184, 186 may include one or more gripping features that provide friction and/or improved grip. These gripping features may include one or more raised bumps, ribs, grooves, knurling, recessed areas, etc. As will be discussed, the first and second pads 184, 186 may collectively define a squeeze actuator. Together, the pads 184, 186 may be squeezed along a squeeze axis 185 (FIG. 1A) for selective flexure of the wall 170 (and the lug 196 supported thereon). For example, the user may use one finger in each of the first and second pads 184, 186 and squeeze the pads 184, 186 together along the axis 185. This may cause the pads 184, 186 to move toward each other in a tangential and/or circumferential direction and may cause the wall 170 and lug 196 to flex outward in the radial direction. In some embodiments, the squeezing of the pads 184, 186 may also cause the wall 170 to flex upward slightly in an arcuate path. The applied load may cause the middle area of the wall 170 to bend and buckle outward radially and upward from a neutral position (FIG. 1A) to an outwardly flexed position. Once the load is reduced, the wall 170 may resiliently bias back toward the neutral position.

Moreover, as shown in FIG. 2, the wall 170 may include an aperture 169. In some embodiments, the aperture 169 may be a notch, groove, or other opening in the lower edge 158 of the outer skirt 156. The aperture 169 may be defined by a first inner rim edge 172, a second inner rim edge 174, and an upper rim edge 176. The first and second inner rim edges 172, 174 may be spaced apart angularly with respect to the axis 101. The first and second inner rim edges 172, 174 may face opposite each other in the circumferential direction and/or the tangential direction about the axis 101 to define a width dimension of the aperture 169. The upper rim edge 176 may face substantially downward along the axis 101 toward the container body 120. Thus, the aperture 169 may be a notch that is elongate in the circumferential/tangential direction. In other words, the aperture 169 may extend along a sector of the cap 110, the sector being defined between the first and second inner rim edges 172, 174 relative to the axis 101. The aperture 169 in the wall 170 may be spaced apart from the tamper-evident member 164 circumferentially. These features may be disposed on opposite sides of the axis 101 and spaced apart angularly about the axis 101 from each other. For example, the aperture 169 may be spaced apart approximately one hundred eighty degrees (180°) from the tamper-evident member 164 of the cap 110.

Furthermore, as shown in FIG. 5, the thickness of the wall 170 may vary so as to define a step 165. The step 165 may lie substantially within a plane that is normal to the axis 101. Thus, the wall 170 may have a reduced thickness from the step 165 down to the lower edge 158. Areas of the wall 170 above the step 165 may have increased thickness to increase stiffness in this area. Moreover, the cap 110 may include one or more ribs extending radially between the outer skirt 156 and the inner skirt 152 and attached to both. There may be one or more (e.g., two) front ribs 180 that extend between the wall 170 and the inner skirt 152. There may also be a plurality of side ribs 181 that extend between the inner skirt 152 and a respective one of the arcuate segments 160, 162. At least one of these side ribs 181 (i.e., side ribs 181') may be disposed at the same circumferential position as terminal ends of the cap thread 154 to stiffen these areas of the cap 110 and inhibit peel-off of the cap 110 from the container body 120 (without unscrewing the cap 110). Furthermore, the cap 110 may include back ribs 182 that extend between the outer and inner skirts 152, 156. The back ribs 182 may be disposed on opposite sides of the tab 161. Moreover, as shown in FIG. 5, the underside of the cover member 150 of the cap 110 may include annular ribs 159, which are centered on the axis 101, and which provide stiffness.

The cap 110 may be removably attached to the neck 126 of the container body 120. FIG. 1A shows a first rotational position of the cap 110 on the neck 126, and this may represent a "fully threaded position" of the cap 110 on the neck 126 according to some embodiments. In this position, the cover member 150 may cover over the opening 124. Also, in this position, a majority of the collar 128 of the container body 120 may be substantially flush with nearby areas of the cap 110. Specifically, as shown in FIG. 1A, the arcuate portions 125 of the collar 128 may lie substantially flush and closely adjacent to the arcuate segments 160, 162 of the outer skirt 156 of the cap 110. Furthermore, the first side wall 151 may be substantially flush and closely adjacent to the first pad 184, the second side wall 153 may be substantially flush and closely adjacent to the second pad 186, and the front wall 157 may be substantially flush and closely adjacent to the wall 170. These flush surfaces between the container body 120 and cap 110 may inhibit access to the underside of the cap 110 to prevent peel-off of the cap 110.

Also, in the position of FIG. 1, the wall 170 may be unflexed and disposed in its neutral position with the first projection 132 received in the aperture 169 of the wall 170. The wall 170 may be disposed proximate the projection 132 with the abutment surface 134 facing the inner rim edge 172 and lug 196 of the cap 110. As will be discussed, the first projection 132 of the container body 110 may limit rotation of the cap 110 due to interference with the inner rim edge 172 and lug 196 of the cap 110 unless the wall 170 is first resiliently flexed radially outward from the neutral position of FIG. 6. As such, the container 100 may impede a person (e.g., a child) from removing the cap 110.

Moreover, in some embodiments, the first projection 132 may interlock with the lug 196, for example, to limit radial flexure of the wall 170, and thereby further secure the cap 110 on the container body 120. For example, the catch 198 may be received in the aperture 133 of the projection 132 and disposed radially between the neck 126 and the lip 113 when the lug 196 is disposed in the neutral position. When the catch 198 is received in the aperture 133, the lip 113 may limit outward radial movement of the catch 198 and, thus, limit rotation of the cap 110 in the twist-off direction. Also, as will be discussed, rotation off the cap 110 may cause the catch 198 to further advance into the receiving aperture 133, thereby wedging the lug 196 into the projection 132, for retaining the cap 110 on the container body 120.

In other embodiments to be discussed, the lug 196 may not include the catch 198 (i.e., the lug may be "catchless"). Accordingly, when the wall 170 is in the neutral position, the lug 196 may not necessarily interlock with the first projection 132. In these embodiments, the aperture 133 may receive at least a portion of the lug 196 if the wall 170 remains in its neutral position during rotation in the twist-off direction. Accordingly, the lug 196 may wedge into the projection to secure the cap 110 on the container body 120.

Figure 8:
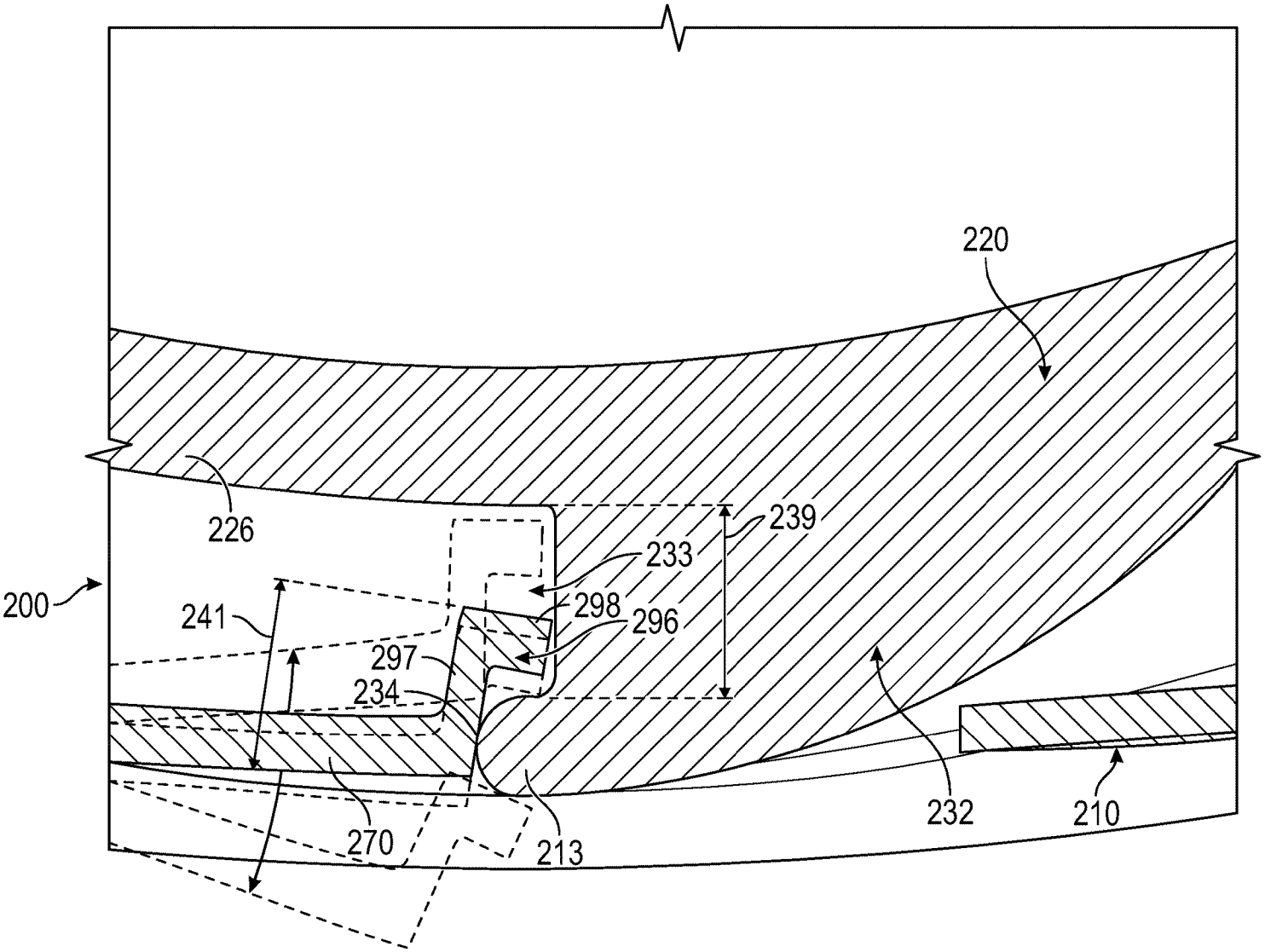
FIG. 8 is a top cross-sectional view of the first retainer feature according to additional embodiments of the present disclosure.

FIG. 8 illustrates the cap 210 and container body 220 of the container 200 according to additional embodiments. These components may include any number of the features discussed above. Components of FIG. 8 that correspond to those of FIGS. 1-7 are indicated with corresponding reference numbers increased by 100.

The wall 270 and the attached lug 296 are shown in the neutral position in solid lines according to example embodiments. As shown in phantom, the wall 270 and lug 296 may move inward radially to an inwardly flexed position. The wall 270 and lug 296 may also move to a second, outwardly flexed position as shown, wherein the wall 270 is radially outboard of the first projection 232 for twist-off of the cap 210.

Figure 6:
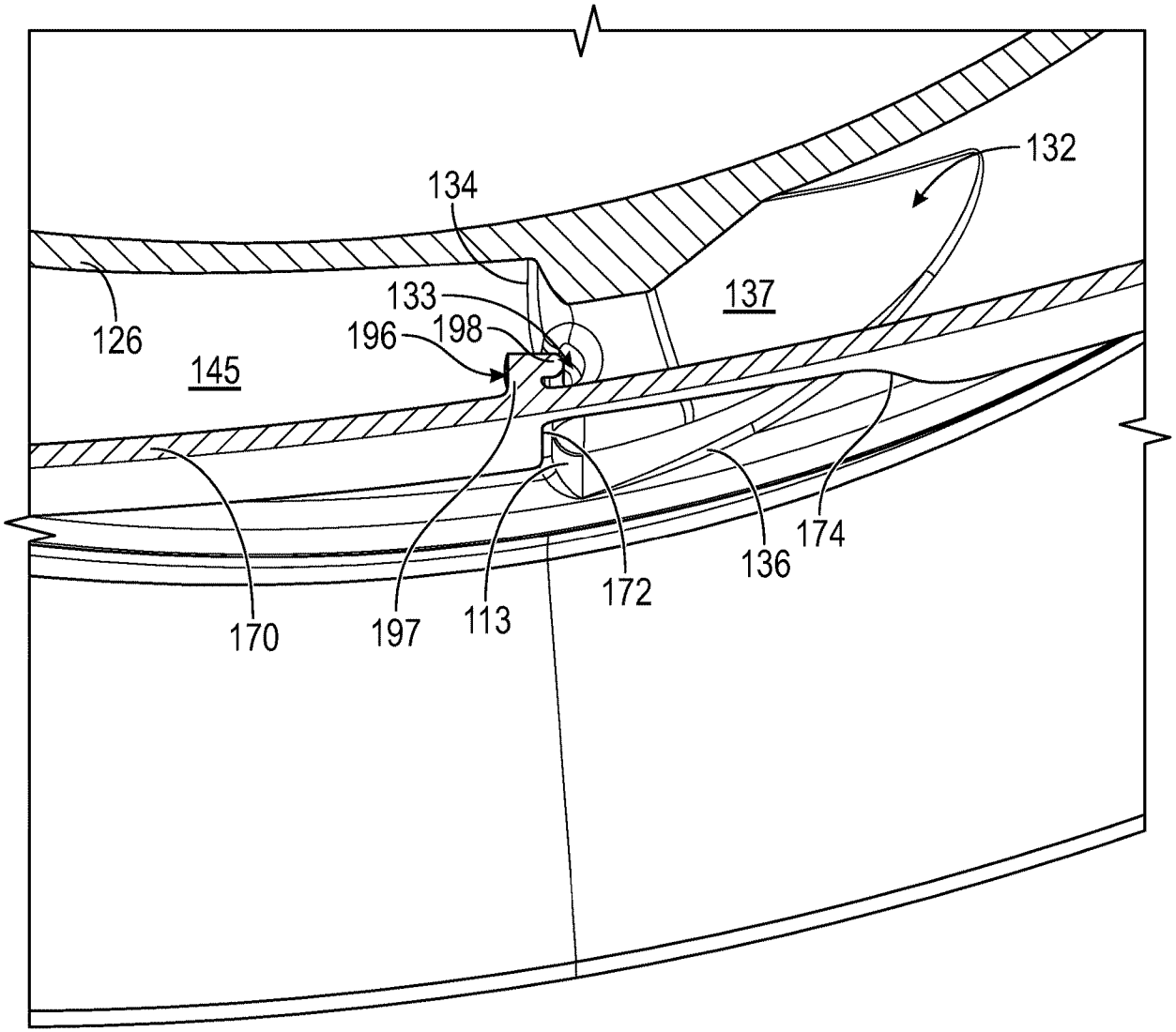
FIG. 6 is a top cross-sectional view of the first retainer feature of FIG. 2.

A width 239 of the aperture 233 (measured between the neck 226 and the lip 213 in the radial direction) may be greater than that of the aperture 133 of FIG. 6. Also, the radial portion 297 of the lug 296 may project inward radially to thereby create more radial distance between the catch 298 and the wall 270 as compared the embodiment of FIG. 6. Furthermore, the lip 213 may include rounded surfaces to as to facilitate manufacture (e.g., to facilitate blow molding manufacture of the container body 120).

As shown, the width 239 of the aperture 233 may be greater than that of the catch 298. Also, the width 239 of the aperture 233 may be greater than a radial length of the 226 of the radial portion 197. Accordingly, the catch 298 may move radially (e.g., inward and outward) within the aperture 233 with rotation of the cap 110. Also, the radial portion 297 of the lug 296 provides ample surface area for abutment with the abutment surface 234 in the event that the cap 110 is rotated in the twist-off direction without first flexing the wall 270 outward radially to bypass the projection 232. Thus, the first projection 232 may securely retain the cap 110 on the container body 120 and prevent removal unless the user first flexes the wall 270 outward radially and moves the catch 298 out of the aperture 233.

Figure 9:
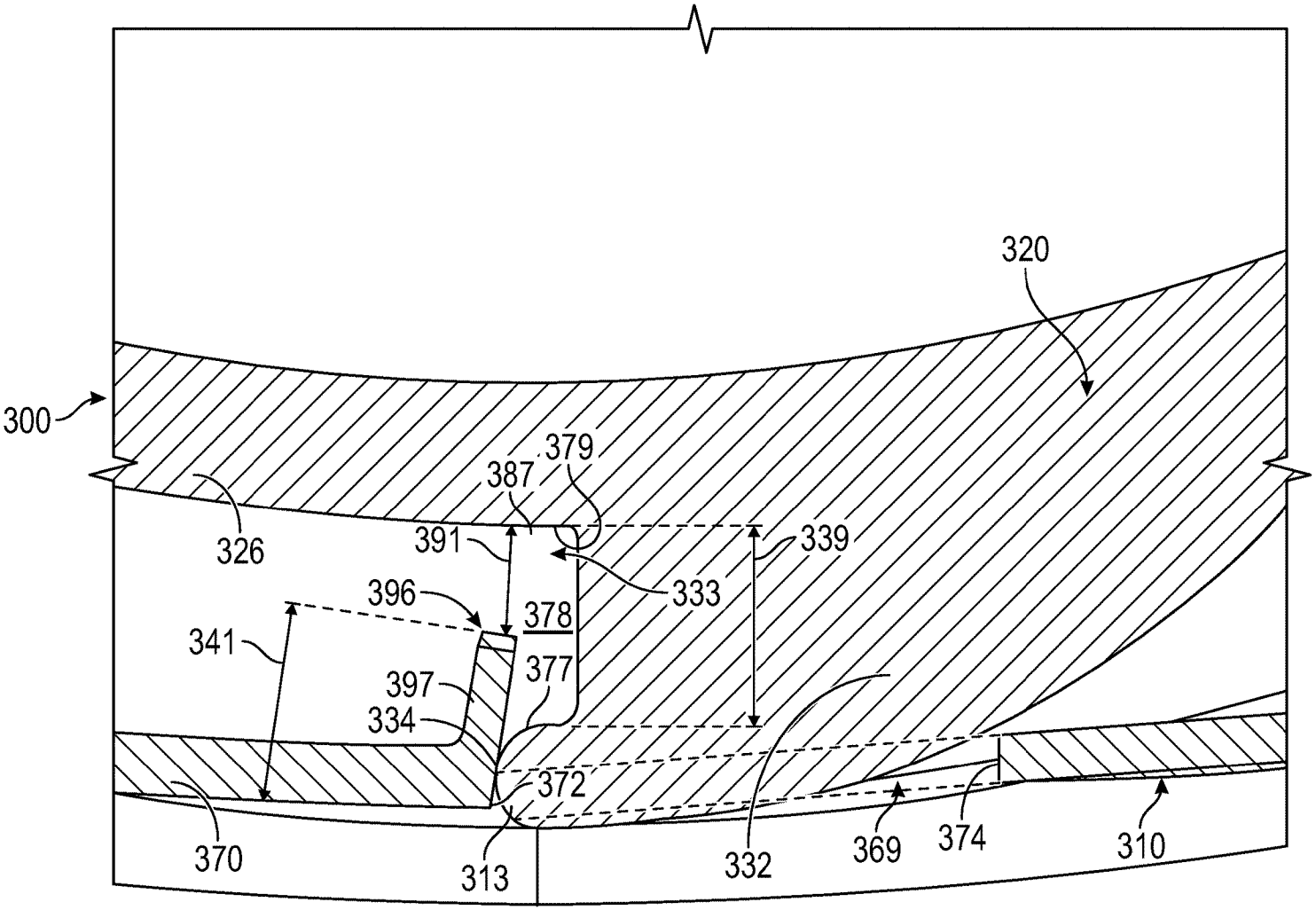
FIG. 9 is a top cross-sectional view of the first retainer feature according to additional embodiments of the present disclosure with the cap shown in a first position.

FIG. 9 illustrates the cap 310 and container body 320 of the container 300 according to additional embodiments. These components may include any number of the features discussed above. Components of FIG. 9 that correspond to those of FIG. 8 are indicated with corresponding reference numbers increased by 100.

The container body 320 may be substantially similar to the embodiments of FIG. 8 so as to include a first projection 332 with a similar aperture 333 disposed radially between the outer radial lip 313 and the neck 326. As such, the aperture 333 may be concave and recessed into the abutment surface 334 of the projection 332. The internal areas of the aperture 333 may be defined by a radially inward-facing first surface 377 of the projection 332 as well as a circumferential- or tangential-facing second surface 378, a radially outward-facing third surface 379, and an axially-upward facing bottom surface 387.

The cap 310 may include the lug 396. As shown, the lug 396 may be "catchless" and may include a rectangular radial portion 397, which extends radially from the wall 370 and from the first inner rim edge 372 of the aperture 369. The lug 396 and the wall 370 are shown in FIG. 9 in the neutral position according to some embodiments. As such, there may be a radial distance 391 defined between the inward edge of the radial portion 397 and the outer diameter surface of the neck 326. The projection 332 may be snugly received in the aperture 369.

Removal of the cap 310 from the container body 320 will now be discussed with reference to FIGS. 9-11. Although not shown, these embodiments of the cap 310 may include a tamper-evident member, such as the tamper evident member 164 illustrated in FIGS. 1A, 1B, and 3. In these embodiments, the tamper evident member 164 may be removed initially. Specifically, the user may grasp the tab 161 and pull downward to tear it from remaining portions of the cap 310. This eliminates rotational interference between the second projection 138 and the abutment member 166 shown in FIG. 3 (i.e., the abutment member 166 disengages the second projection 138 when the tab 161 is torn away).

Figure 10:
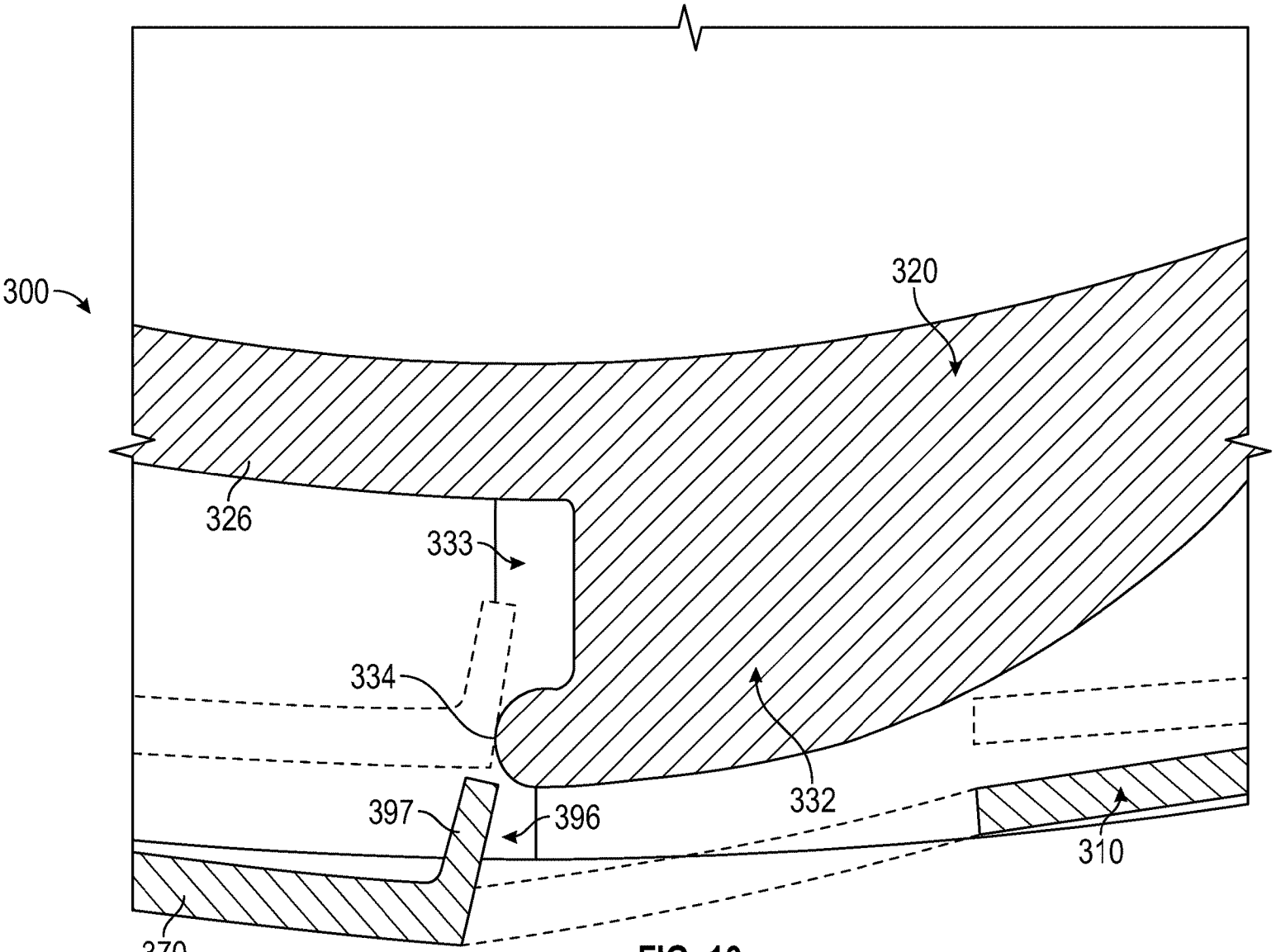
FIG. 10 is a top cross-sectional view of the first retainer feature of FIG. 9 with the cap shown in an outwardly flexed second position.

Next, the wall 370 and lug 396 may be selectively moved radially outward to the position shown in FIG. 10. Although not shown, these embodiments of the cap 310 may include a squeeze actuator, such as the first and second pads 184, 186 shown in FIGS. 1A and 1B for these purposes. The actuator may be squeezed, causing the wall 370 to resiliently flex outward radially. Specifically, central areas of the wall 370 may bow, bend, and buckle outward radially and/or upward toward the flexed position (shown in solid lines in FIG. 10). It is noted that the cap 310 may remain in the fully threaded position as the pads are squeezed together and the wall 370 is flexed outward/upward. This may move the lug 396 away from the projection 332 such that there is rotational clearance between the two features (i.e., the projection 332 no longer interferes with twist-off rotation of the cap 110 from the container body 120). In other words, the projection 332 may be disposed outside the aperture 369 of the cap 310. This may be referred to as the unretained position of the wall 370 because it is now ready to bypass the projection 332 when rotated in the twist-off direction. Specifically, the user may maintain the squeezing pressure on the pads and begin to rotate the cap 310 in the twist-off direction.

Figure 11:
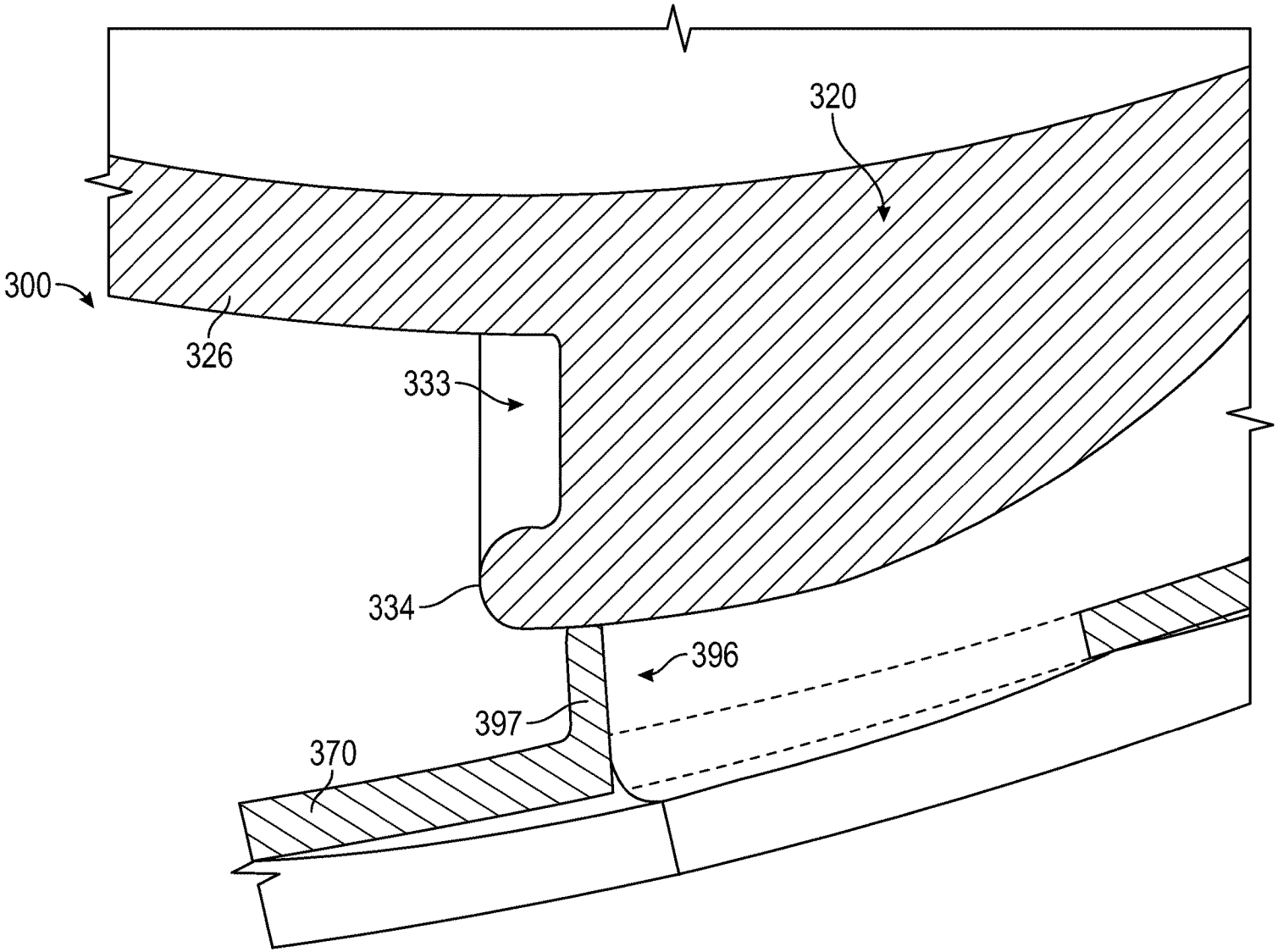
FIG. 11 is a top cross-sectional view of the first retainer feature of FIGS. 9 and 10 with the cap shown in the second position and rotated relative to the container body.

As shown in FIG. 11, the cap 310 may move to a second threaded (partially threaded) position on the neck 326, wherein the wall 370 has moved angularly relative to the projection 332. The wall 370, in this position, may begin to resiliently recover back (bias radially inward) toward the neutral position. The user may stop squeezing the pads and continue to twist the cap 310 off of the neck 326 until it is removed.

To replace the cap 310 onto the neck 326, the user may thread and rotate the cap 310 onto the neck 326 in the twist-on direction. Eventually, the lug 396 encounters the projection 332. Further rotation of the cap 310 in the twist-on direction causes the lug 396 to cam against the projection 332, thereby flexing the wall 370 outward radially. Still further rotation of the cap 310 in the twist-on direction cause the wall 370 to resiliently snap back in place in the neutral position with the projection 332 received in the aperture 369 (FIG. 9). The projection 332 is exposed and visible to the user via the aperture 369, thereby assuring the user that the cap 310 is secured and retained on the container body 320. Likewise, the wall 370 of the cap 310 may audibly snap back into place when the cap 310 is fully threaded onto the container body 320, thereby providing further assurance that the cap 310 is securely attached.

Figure 12:
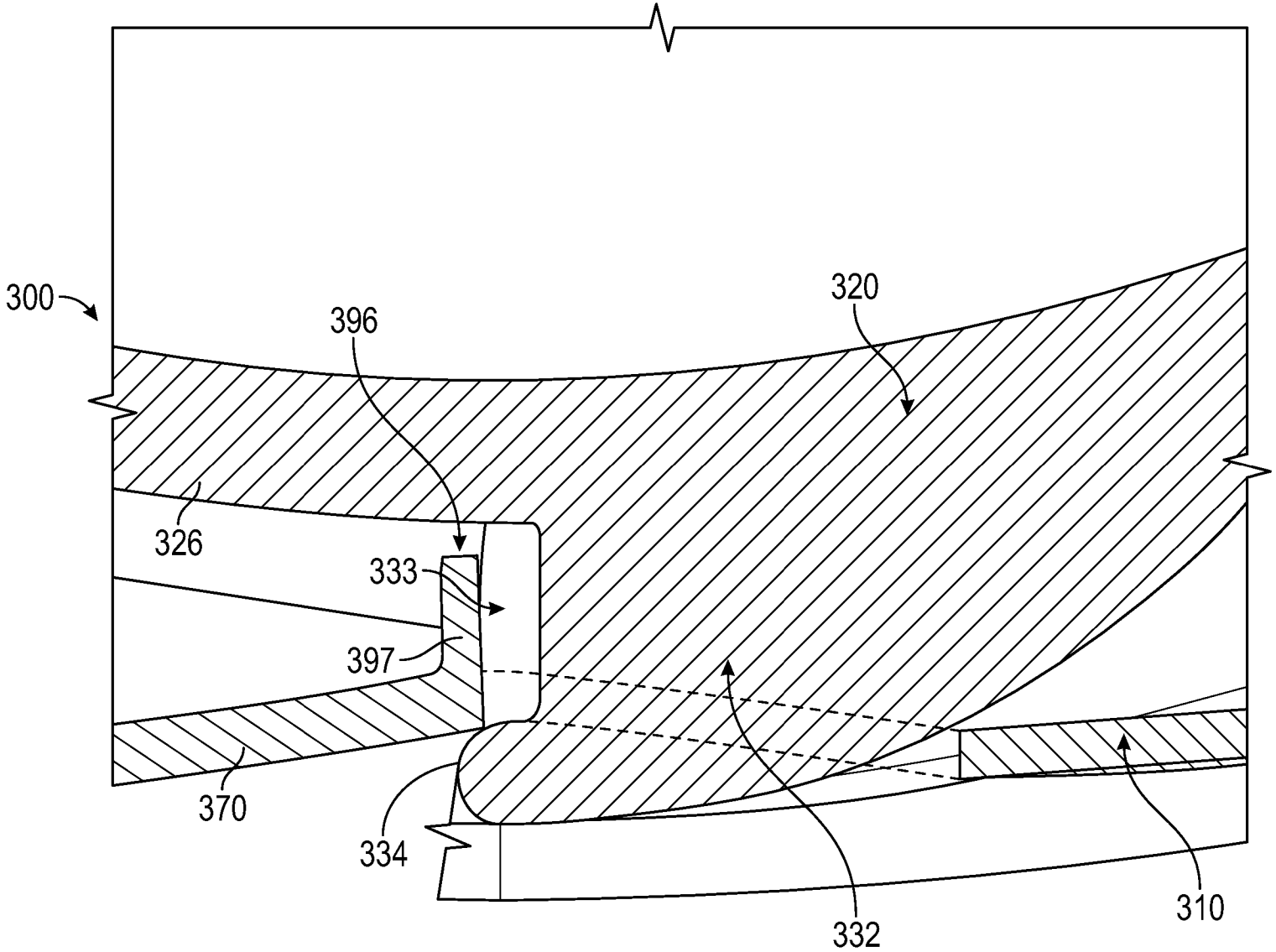
FIG. 12 is a top cross-sectional view of the first retainer feature of FIGS. 9-11 with the cap shown in an inwardly flexed third position.

Another scenario is represented in FIG. 12, wherein the cap 310 is initially in the fully threaded position on the container body 320. A user (e.g., a child) may attempt to twist-off the cap 310 without first flexing the wall 370 outwardly from the neutral position. The twist-off motion of the cap 310 may cause the abutment surface 334 to abut the radial portion 397. Further rotation may cam (i.e., direct) the lug 396 radially inward. The aperture 333 may receive the radial portion 397 of the lug 396. In other words, the lug 396 may move radially inward and wedge into the aperture 333 such that the projection 332 limits further rotation in the twist-off direction. The cap 310 may need to be rotated in the opposite direction (i.e., reversed in the twist-on direction) to move the lug 396 out of the aperture 333 before the cap 310 can be squeezed and removed as shown in FIGS. 10 and 11. Accordingly, the cap 310 may be robustly secured to the container body 320.

Figure 13:
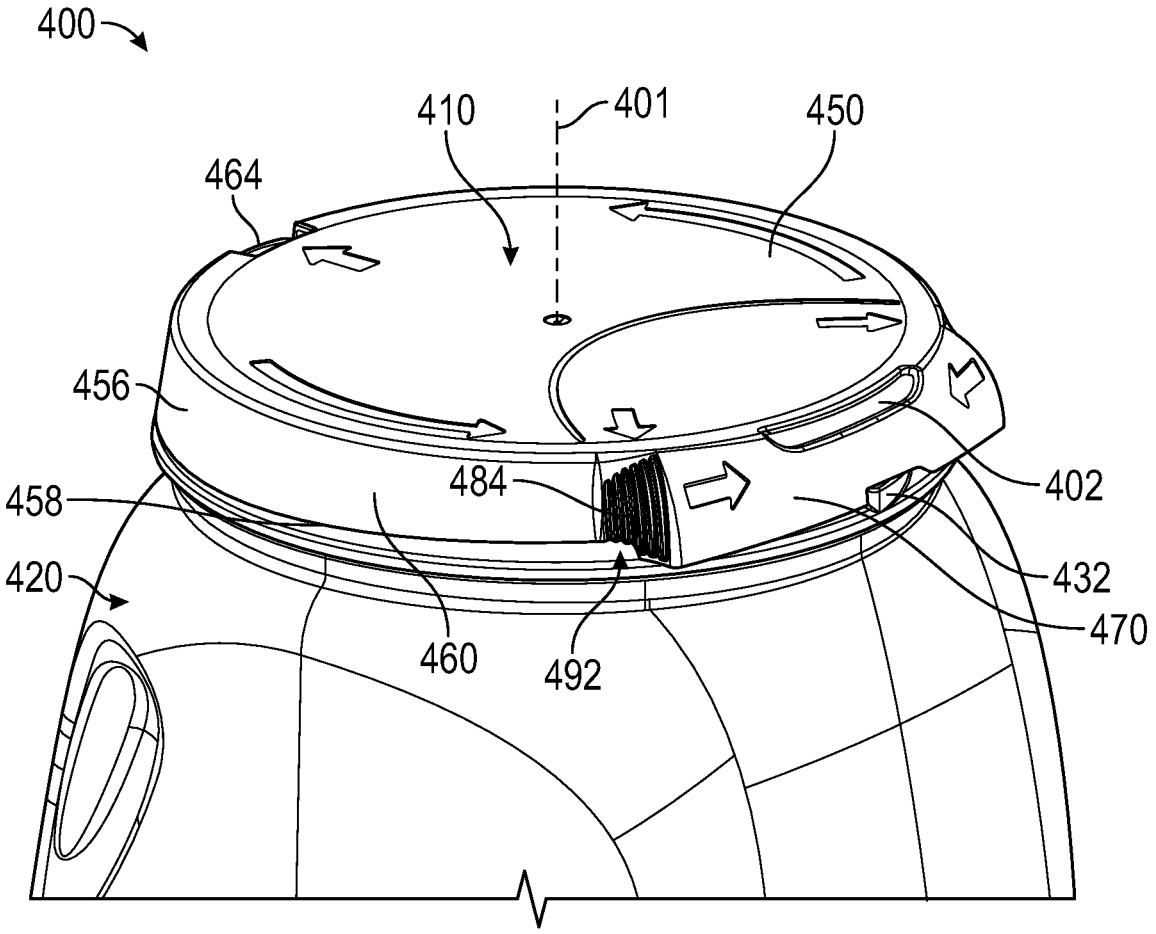
FIG. 13 is an isometric view of the child-resistant container and cap according to additional example embodiments of the present disclosure.
Figure 14:
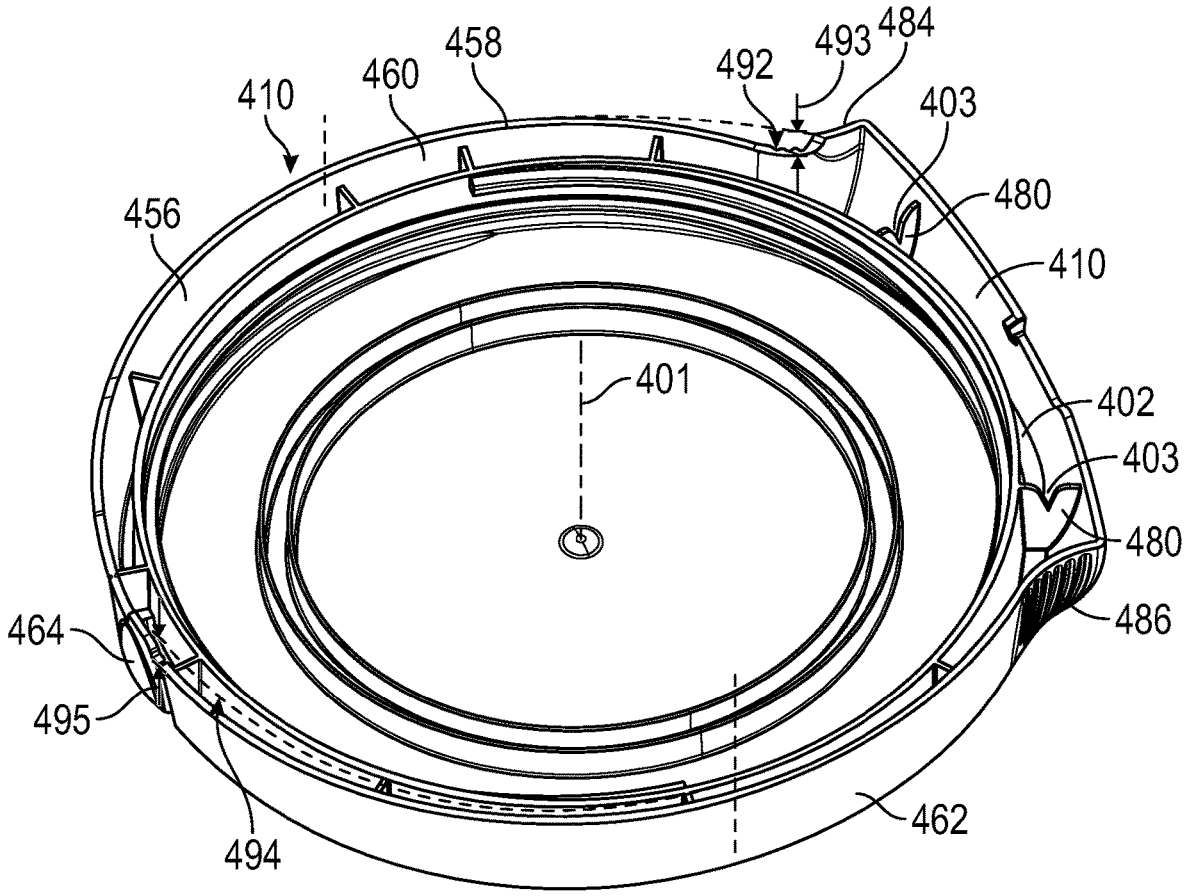
FIG. 14 is an isometric view of an underside of the cap of FIG. 13.

FIGS. 13-14 illustrate the cap 410 and container body 420 of the container 400 according to further embodiments. These components may include any number of the features discussed above. Components of FIG. 13-14 that correspond to those of FIGS. 9-12 are indicated with corresponding reference numbers increased by 100.

As shown in FIGS. 13 and 14, the outer skirt 456 of the cap 410 may include the first arcuate segment 460, which extends circumferentially about the axis 401 between the first pad 484 and the tamper-evident member 464. The outer skirt 456 may also include the second arcuate segment 462, which extends circumferentially about the axis 401 between the second pad 486 and the tamper-evident member 464.

The lower edge 458 of the first arcuate segment 460 may include a first trimmed area 492 proximate the first pad 484. In some embodiments, the lower edge 458 may be tapered axially to define the first trimmed area 492. The length of the arcuate segment 460 (as measured axially from the cover member 450 to the lower edge 458) may gradually reduce as the arcuate segment 460 extends toward the first pad 484. A step 493 may be defined on the lower edge 458, at the first pad 484. A phantom line is shown in FIG. 14 and it represents a more continuous lower edge (e.g., similar to the embodiments of FIGS. 1-12) for purposes of emphasizing the shape of the first trimmed area 492. Similarly, the second arcuate segment 462 may include a second trimmed area 494 proximate the tamper-evident member 464. The lower edge 458 may gradually taper in length, and a step 495 may be defined at the tamper-evident member 464. During twist-off of the cap 410, the first trimmed area 492 receives the first projection 432 and allows passage of the projection 432 to allow further rotation of the cap 410. Likewise, the second trimmed area 494 receives the second projection (not specifically shown but described above) and allows passage of the second projection to allow further rotation of the cap 410. Conversely, during twist-on of the cap 410, the first and second trimmed areas 492, 494 may receive the first and second projections to allow further rotation of the cap 410 onto the container 420.

Moreover, the cap 410 may include a slot 402. The slot 402 may be defined through the cap 410 and may be disposed at a transition between the cover member 450 and the outer skirt 456. The slot 402 may be elongated in a direction extending about the axis 401. The slot 402 may affect flexibility of the squeeze actuator of the cap 410. For example, when the first and second pads 484, 486 are squeezed together, the wall 470 may resiliently flex and rotate upward slightly about an axis that is perpendicular to the axis 401 because of the slot 402. The wall 470 may, in addition, flex outward radially from the axis 401 when the pads 484, 486 are squeezed together. The length of the slot 402 may be longer to increase flexibility of the wall 470 or may be shorter to decrease its flexibility.

In addition, as shown in FIG. 14, the ribs 480 may include notches 403 that are open to the bottom side of the cap 410. The notches 403 may be V-shaped as shown; however, the notches 403 may have a squared, rounded, or other shape without departing from the scope of the present disclosure. The notches 403 may provide increased flexibility for the squeeze actuator of the cap 410. Also, the notches 403 may be adjusted in size, shape, etc. to thereby control the flexibility of the squeeze actuator.

There has thus been provided child-resistant containers or packages having unique child deterring features that retain the cap in a secured position on the container body. These features may be manipulated to unsecure the cap; however, performing these actions may prove physically and/or cognitively challenging for some (e.g., young children). These features may, in fact, be configured for other users (e.g., adults) such that the child-deterring features may be intuitive and ergonomic for use. Thus, the container of the present disclosure may provide relatively high levels of child deterrence, while remaining relatively easy-to-use for the majority of adults. The container may be manufactured efficiently as well.

While the foregoing description focuses primarily on articles of manufacture, namely, child-resistant containers, there has also been disclosed methods for manufacturing child-resistant containers. Such methods for manufacturing child-resistant containers having the features discussed herein may entail direct fabrication of any component included within the cap and/or neck of the container, partial or complete assembly of the cap and/or neck, or any combination thereof. Further, any number of entities can fabricate the components of the container, which can be produced utilizing various manufacturing techniques including, but not limited to, blow molding, injection molding, and additive manufacturing processes. Furthermore, a method for manufacturing a child-resistant package may include the step or process of installing and attaching the cap to the container neck. In further instances, the above-described method for manufacturing a child-resistant package may include the step or process of providing the neck (whether by purchase from a supplier, by independent fabrication, or by otherwise obtaining the container neck). Additionally, in at least some implementations, the method may include providing the cap (whether by purchase, by independent fabrication, or by otherwise obtaining the cap).

Terms such as "first" and "second" have been utilized above to describe similar features or characteristics (e.g., rotational directions) in view of the order of introduction during the course of description. In other sections of this Application, such terms can be varied, as appropriate, to reflect a different order of introduction. While at least one exemplary embodiment has been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It is understood that various changes may be made in the function and arrangement of elements described in an exemplary embodiment without departing from the scope of the invention as set forth in the appended claims.

What is claimed is:

1. A child-resistant container, comprising:

a cap with a cover member, an inner member that depends from the cover member, and an outer member that depends from the cover member, an axis extending through the cover member, the outer member being moveable relative to the axis radially between a first position and a radially displaced position, the outer member of the cap including a squeeze actuator with a first pad and a second pad that are disposed on opposite sides of the axis and aligned along a squeeze axis that is spaced away radially from the axis, the first and second pads configured for manual squeezing along the squeeze axis for selective movement of the outer member from the first position toward the radially displaced position;

a container body with a neck that defines an opening to an inner cavity within the container body, the axis extending through the opening, the neck engaged with the inner member to support rotational movement of the cap in a twist-off direction and a twist-on direction about the axis, the container body having a projection that engages the outer member and limits rotational movement of the cap when the outer member is in the first position and the cap is contemporaneously rotated in the twist-off direction, the outer member bypassing the projection when the outer member is in the radially displaced position and the cap is contemporaneously rotated in the twist-off direction; and the projection including a receiving aperture that receives at least part of the outer member when the outer member is in the first position and the cap is contemporaneously rotated in the twist-off direction;

wherein the outer member depends from the cover member and terminates at a lower edge, wherein the outer member includes an outer member aperture defined in the lower edge, wherein the outer member includes a lug that is disposed at a side of the aperture and that projects radially inward, wherein the aperture is configured to receive the projection of the container body, and wherein the lug engages the projection for limiting rotational movement of the cap in the twist-off direction.

2. The container of claim 1, wherein the projection includes an abutment surface facing in a direction that opposes the twist-off direction, wherein the projection includes a top surface that faces axially along the axis;

wherein the receiving aperture is recessed into the abutment surface and the top surface to include internal surfaces facing upward axially, inward radially, outward radially, and in the direction that opposes the twist-off direction.

3. The container of claim 1, wherein the neck is threadably engaged with the inner member of the cap.

4. The container claim 1, wherein the outer member is resiliently flexible between the first position and the radially displaced position; and wherein the outer member is biased toward the first position.

5. The container of claim 1, wherein the container body includes a collar that is substantially flush with the outer member of the cap.

6. The container of claim 5, wherein the collar includes at least one surface that is substantially flush with the first pad or the second pad.

7. The container of claim 1, wherein the cap includes a thread that threadably engages the neck of the container body, the thread including a terminal end;

wherein the cap includes a rib that is attached to the inner member and the outer member; and wherein the terminal end of the thread and the rib are disposed at a common circumferential position with respect to the axis.

8. The container of claim 1, wherein the projection of the container body is one of a plurality of projections, the plurality of projections being disposed with rotational symmetry with respect to the axis.

9. A child-resistant container, comprising:

a cap with a cover member, an inner member that depends from the cover member, and an outer member that depends from the cover member, an axis extending through the cover member, the outer member being moveable relative to the axis radially between a first position and a radially displaced position, the outer member of the cap including a squeeze actuator with a first pad and a second pad that are disposed on opposite sides of the axis and aligned along a squeeze axis that is spaced away radially from the axis, the first and second pads configured for manual squeezing along the squeeze axis for selective movement of the outer member from the first position toward the radially displaced position;

a container body with a neck that defines an opening to an inner cavity within the container body, the axis extending through the opening, the neck engaged with the inner member to support rotational movement of the cap in a twist-off direction and a twist-on direction about the axis, the container body having a projection that engages the outer member and limits rotational movement of the cap when the outer member is in the first position and the cap is contemporaneously rotated in the twist-off direction, the outer member bypassing the projection when the outer member is in the radially displaced position and the cap is contemporaneously rotated in the twist-off direction; and the projection including a receiving aperture that receives at least part of the outer member when the outer member is in the first position and the cap is contemporaneously rotated in the twist-off direction;

wherein the outer member of the cap includes a segment that extends about the axis from the first pad, the segment depending from the cover member of the cap and terminating at a lower edge, the lower edge including a trimmed area proximate the first pad, the trimmed area receiving the projection and allowing passage of the projection during rotational movement of the cap in the twist-off direction.

10. The container of claim 9, wherein the outer member includes a wall and a lug that projects radially inward from the wall, the lug including an abutment surface that engages the projection of the container body for limiting rotational movement of the cap, the wall and the lug supported for movement between the first position and the radially displaced position.

11. The container of claim 10, wherein the lug is configured to move radially inward from the first position toward the axis to wedge into the receiving aperture when the cap is rotated in the twist-off direction with the outer member in the first position.

12. The container of claim 11, wherein the projection includes a lip, wherein the receiving aperture is disposed radially between the lip and the neck; and wherein the lug includes a catch that is received within the receiving aperture between the lip and the neck when the outer member is in the first position.

13. The container of claim 12, wherein the lug includes a radial portion and the catch, the radial portion projecting radially inward from the wall, the abutment surface included on the radial portion, the catch projecting from the radial portion to be received in the receiving aperture.

14. The container of claim 11, wherein the lug is catchless with a majority the lug remaining outside the receiving aperture when the outer member is in the first position;

wherein the lug wedges into the receiving aperture when the cap is rotated in the twist-off direction with the outer member in the first position.

15. The container of claim 9, wherein the neck is threadably engaged with the inner member of the cap.

16. The container of claim 9, wherein the outer member is resiliently flexible between the first position and the radially displaced position; and wherein the outer member is biased toward the first position.

17. The container of claim 9, wherein the container body includes a collar that is substantially flush with the outer member of the cap.

18. The container of claim 9, wherein the projection of the container body is one of a plurality of projections, the plurality of projections being disposed with rotational symmetry with respect to the axis.

* * * * *